US009845954B2

(12) United States Patent
Wakabayashi

(10) Patent No.: US 9,845,954 B2
(45) Date of Patent: Dec. 19, 2017

(54) COMBUSTION CONTROL DEVICE

(71) Applicant: SHIZUOKA SEIKI CO., LTD, Shizuoka (JP)

(72) Inventor: Hiroaki Wakabayashi, Shizuoka (JP)

(73) Assignee: Shizuoka Seiki Co., LTD, Shizuoka (JP)

( * ) Notice: Subject to any disclaimer, the term of this patent is extended or adjusted under 35 U.S.C. 154(b) by 358 days.

(21) Appl. No.: 14/532,327

(22) Filed: Nov. 4, 2014

(65) Prior Publication Data

US 2015/0125799 A1 May 7, 2015

(30) Foreign Application Priority Data

Nov. 7, 2013 (JP) ..... 2013-231132

(51) Int. Cl.
*F23N 5/00* (2006.01)
*F23N 5/18* (2006.01)
*F23N 5/24* (2006.01)

(52) U.S. Cl.
CPC ..... *F23N 5/00* (2013.01); *F23N 5/184* (2013.01); *F23N 5/242* (2013.01); *F23D 2900/00019* (2013.01); *F23D 2900/14125* (2013.01); *F23N 2025/04* (2013.01); *F23N 2027/02* (2013.01); *F23N 2031/00* (2013.01); *F23N 2033/08* (2013.01); *F23N 2900/05005* (2013.01)

(58) Field of Classification Search
CPC .. F23N 5/00; F23N 2900/05005; F23N 5/242; F23D 2900/00019
USPC ..... 431/38; 137/498, 516.25; 251/118
See application file for complete search history.

(56) References Cited

U.S. PATENT DOCUMENTS 3,958,421 A * 5/1976 Kelly ..... F02G 1/044 60/517
7,318,592 B2 * 1/2008 Iwamoto ..... B62K 21/08 137/493.9
2004/0214118 A1 * 10/2004 Sullivan ..... F23N 1/022 431/12

(Continued)

FOREIGN PATENT DOCUMENTS

JP 11-159745 6/1999
JP 2000-346532 A 12/2000

*Primary Examiner* — Avinash Savani
*Assistant Examiner* — Rabeeul Zuberi
(74) *Attorney, Agent, or Firm* — Miller Canfield Paddock and Stone; Mark L Maki

(57) ABSTRACT

An object of the present invention is to realize a combustion control device that reduces, when a pressure within a mixer is rapidly increased at the time of ignition of the combustion control device, the transmission of the temporarily increased pressure to a pressure sensor, that brings the pressure sensor into a non-operated state and that thereby can continue combustion in the combustion control device. Hence, a combustion control device is provided that includes: a combustion chamber which has a heat dissipation disc on a front surface and within which a combustion room is formed; a burner which is attached to the combustion chamber; a mixer which mixes a gas supplied to the burner with air; and a pressure sensor which is connected to the mixer through a pressure passage, where a pressure propagation delay means which reduces transmission to the pressure sensor caused by a temporary pressure increase within the mixer is provided partway along the pressure passage.

9 Claims, 2 Drawing Sheets

(56) References Cited

U.S. PATENT DOCUMENTS

2012/0164590 A1* 6/2012 Mach ..... F23D 14/145
431/328

* cited by examiner

COMBUSTION CONTROL DEVICE

CROSS REFERENCE TO RELATED APPLICATIONS

This application is based on and claims priority under 35 U. S. C. §119 to Japanese Patent Application No. 2013-231132, filed on Nov. 7, 2013, the entire content of which is incorporated herein by reference.

TECHNICAL FIELD

The present invention relates to a combustion control device, and more particularly relates to a combustion control device in which a pressure within a mixer is rapidly increased at the time of ignition of the combustion control device, the transmission of the temporarily increased pressure to a pressure sensor is reduced, the pressure sensor is brought into a non-operated state and thus the combustion of the combustion control device is continued.

BACKGROUND ART

As an example of the combustion control device, there is a combustion control device that will be disclosed below in patent document 1.

The combustion control device disclosed in patent document 1 is a combustion device which previously mixes a combustion gas and air to feed it into the flame hole of a burner, which includes a mixture supply passage for feeding the mixture obtained by mixing the combustion gas and the air into the flame hole of the burner, a bypass passage whose entrance portion and exit portion are open into the mixture supply passage and a mixture amount sensor that is arranged partway along the bypass passage, in which the exit portion of the bypass passage is open to a portion close to the flame hole of the burner as compared with the entrance portion on a downstream side, and the mixture amount sensor measures the quantity of flow of the mixture divided to the side of the bypass passage among the mixture flowing into the mixture supply passage.

The combustion control device disclosed in patent document 1 accurately controls an air-fuel ratio without being affected by clogging of the burner or the like.

RELATED ART DOCUMENT

Patent Document

Patent document 1: Japanese Unexamined Patent Application Publication No. H11-159745

DISCLOSURE OF THE INVENTION

Problems to be Solved by the Invention

Incidentally, a conventional combustion control device includes, for example, a combustion chamber, a burner (also called a "metal knit burner"), a mixer and a pressure sensor.

Here, the combustion chamber has a heat dissipation disc on the front side and a combustion room therewithin.

The burner is attached to the back surface side of the combustion chamber.

Furthermore, the mixer mixes a gas formed of propane, natural gas or the like with air to supply the mixture to the burner.

Then, in order for the pressure within the mixer, for example, the state of clogging of the exit of the burner to be checked, one end of a pressure passage is connected to the mixer, and, the other end of the pressure passage is connected to the pressure sensor.

At the time of ignition of the combustion control device, the pressure within the combustion chamber is instantaneously and rapidly increased by the pressure of the ignition of the gas combustion.

Here, since the combustion chamber of the combustion control device has a heat dissipation disc on the front side, it is difficult to remove the pressure within the combustion chamber.

Then, when the pressure within the combustion chamber is rapidly increased, the burner portion is instantaneously brought into the state where it is completely clogged.

Consequently, the pressure within the mixer is also rapidly increased by the pressure within the combustion chamber that is prevented from being moved, as shown in FIG. 5, this pressure acts on the pressure sensor through the pressure passage and a "peak" is produced and the pressure sensor is operated, with the result that it is disadvantageously impossible to continue the combustion in the combustion control device.

An object of the present invention is to realize a combustion control device that reduces, when a pressure within a mixer is rapidly increased at the time of ignition of the combustion control device, the transmission of the temporarily increased pressure to a pressure sensor, that brings the pressure sensor into a non-operated state and that thereby can continue combustion in the combustion control device.

Means for Solving the Problem

Hence, in order to remove the above inconvenience, according to the present invention, there is provided a combustion control device including: a combustion chamber which has a heat dissipation disc on a front surface and within which a combustion room is formed; a burner which is attached to the combustion chamber; a mixer which mixes a gas supplied to the burner with air; and a pressure sensor which is connected to the mixer through a pressure passage, where a pressure propagation delay means which reduces transmission to the pressure sensor caused by a temporary pressure increase within the mixer is provided partway along the pressure passage.

Effects of the Invention

In the present invention, since in the combustion control device, the pressure propagation delay means for reducing the transmission to the pressure sensor caused by the temporary pressure increase within the mixer is provided partway along the pressure passage making the mixer communicate with the pressure sensor, when the pressure within the mixer is rapidly increased at the time of ignition of the combustion control device, the pressure propagation delay means reduces the transmission of the temporarily increased pressure to the pressure sensor, and thus it is possible to bring the pressure sensor into a non-operated state.

In this way, since it is possible to keep the pressure sensor in the non-operated state, it is possible to continue the combustion in the combustion control device.

BEST MODE FOR CARRYING OUT THE INVENTION

Embodiments of the present invention will be described in detail below with reference to drawings.

First Embodiment

Figure 1:
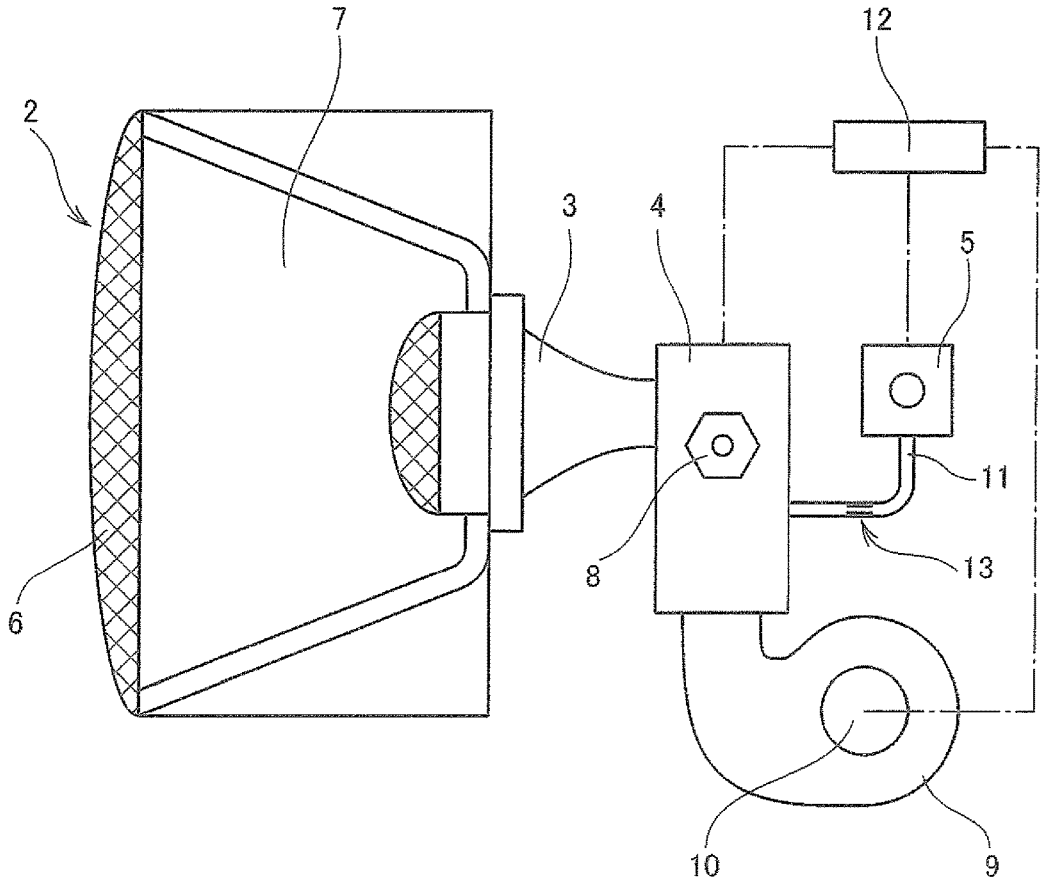
FIG. 1 is a schematic configuration diagram of a combustion control device (first embodiment)
Figure 2:
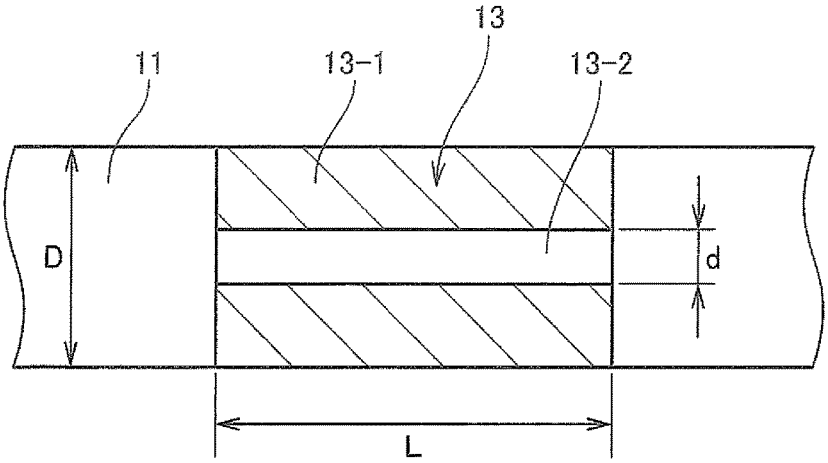
FIG. 2 is an enlarged cross-sectional view of the main portion of an orifice (first embodiment)
Figure 3:
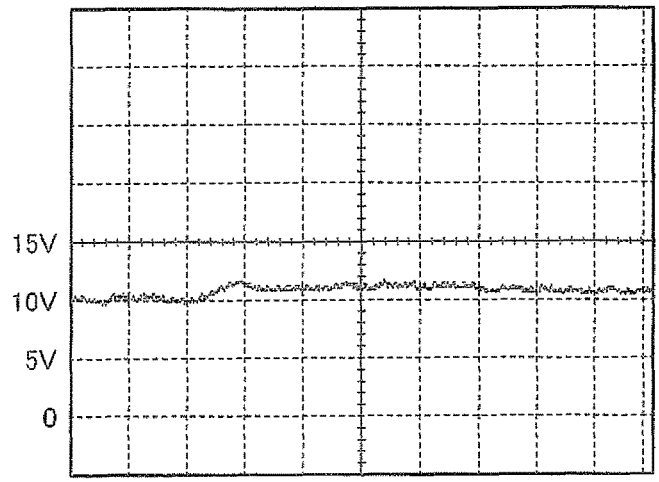
FIG. 3 is a diagram showing variations in the pressure of the combustion control device (first embodiment)

FIGS. 1 to 3 show a first embodiment of the present invention.

In FIG. 1, reference numeral 1 represents a combustion control device.

The combustion control device 1 includes a combustion chamber 2, a burner 3, a mixer 4 and a pressure sensor 5.

Specifically, the combustion chamber 2 includes, as shown in FIG. 1, a heat dissipation disc 6 on the front side, and forms a combustion room 7 therewithin.

The burner 3 is also called a "metal knit burner", and is attached to the back side of the combustion chamber 2.

Furthermore, the mixer 4 mixes a gas formed of propane, natural gas or the like with air to supply the mixture to the burner 3. Here, a nozzle 8 is connected to the mixer 4, and a gas line is connected to the nozzle 8. A combustion fan 9 is also connected to the mixer 4, the combustion fan 9 is rotated by the drive of a combustion fan motor 10 and air is supplied to the mixer 4.

Then, in order for the pressure within the mixer 4, for example, the state of clogging of the exit of the burner 3 to be checked, one end of a pressure passage 11 is connected to the mixer 4, and, the other end of the pressure passage 11 is connected to the pressure sensor 5.

The combustion control device 1 includes a control means 12 that controls, for example, the combustion state.

As shown in FIG. 1, the mixer 4 is connected to the control means 12, and thus the state of agitation of the mixer 4 is controlled.

The pressure sensor 5 is connected to the control means 12, and a detection signal from the pressure sensor 5 is input.

Moreover, a supply amount adjustment means (not shown) arranged partway along the gas line of the nozzle 8 is also connected to the control means 12, and the amount of gas supplied is controlled.

Furthermore, the combustion fan motor 10 is also connected to the control means 12, the combustion fan motor 10 is driven and controlled to rotate the combustion fan 9 and air is supplied to the mixer 4, with the result that the combustion state is controlled.

In the combustion control device 1, partway along the pressure passage 11, a pressure propagation delay means 13 is provided that reduces transmission to the pressure sensor 5 by a temporarily increased pressure within the mixer 4.

Specifically, the pressure propagation delay means 13 is formed with an orifice.

In other words, in the pressure propagation delay means 13, as shown in FIG. 2, a main body portion 13-1 arranged partway along the pressure passage 11 is formed of, for example, brass into the shape of a cylinder, and in the center of the main body portion 13-1, a communication hole portion 13-2 penetrating in a longitudinal direction is formed.

Here, when the passage diameter D of the pressure passage 11 is set at, for example, 4 mm, the diameter d of the communication hole portion 13-2 of the pressure propagation delay means 13 is set at, for example, 1 mm in consideration of a state where the pressure is increased.

The length L of the main body portion 13-1 of the pressure propagation delay means 13 is set at, for example, 20 mm.

An action will be described.

The supply amount adjustment means is controlled by the control means 12 of the combustion control device 1 to supply the gas to the mixer 4 through the nozzle 8, and on the other hand, the combustion fan motor 10 is driven and controlled to rotate the combustion fan 9 to supply air to the mixer 4.

Then, while the agitation state of the mixer 4 is being controlled by the control means 12, the combustion state of the burner 3 is controlled.

At the time of ignition of the combustion control device 1 that is, at the time of combustion control described above, the pressure within the combustion chamber 2 is rapidly increased by the pressure of the ignition of the gas combustion.

However, since the combustion chamber 2 of the combustion control device 1 has the heat dissipation disc 6 on the front side, and thus it is difficult to remove the pressure, the burner portion 3 is instantaneously brought into the state where it is completely clogged.

Then, the pressure within the mixer 4 is also rapidly increased by the pressure within the combustion chamber 2 that is prevented from being moved, this rapidly increased pressure is passed to the pressure passage 11.

Here, although the rapidly increased pressure reaches the pressure propagation delay means 13 arranged partway along the pressure passage 11, since the rapidly increased pressure is gradually passed through the communication hole portion 13-2 formed in the pressure propagation delay means 13, as shown in FIG. 3, the communication hole portion 13-2 of the pressure propagation delay means 13 reduces the transmission of the rapidly increased pressure to the pressure sensor 5, that is, a "peak cut" is performed.

In this way, since the pressure propagation delay means 13 for reducing the transmission to the pressure sensor 5 by the temporary pressure increase within the mixer 4 is provided partway along the pressure passage 11, even if at the time of ignition of the combustion control device 1, the pressure within the mixer 4 is rapidly increased, that is, the pressure is instantaneously increased, the transmission of the pressure temporarily increased to the pressure sensor 5 can be reduced by the pressure propagation delay means 13, with the result that it is possible to bring the pressure sensor 5 into a non-operated state.

Hence, since it is possible to keep the pressure sensor 5 in the non-operated state, it is possible to continue the combustion of the combustion control device 1.

Moreover, the pressure propagation delay means 13 is formed with the orifice, and thus it is possible to expect the effect of the pressure reduction described above, and on the other hand, since the configuration is simple and it is easy to perform its production, it is possible to reduce its cost.

Second Embodiment

Figure 4:
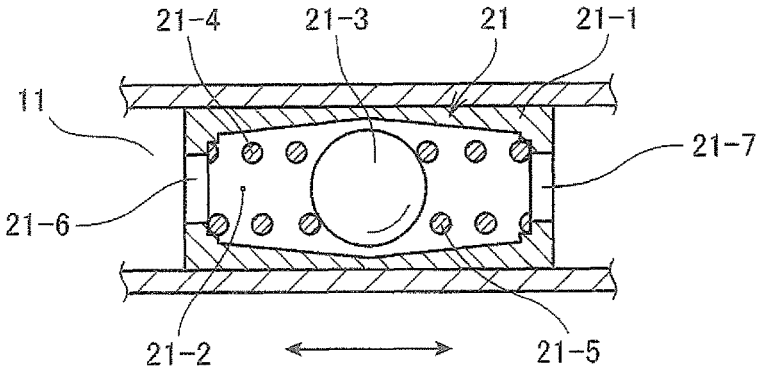
FIG. 4 is an enlarged cross-sectional view of the main portion of a pressure adjustment valve (second embodiment)
Figure 5:
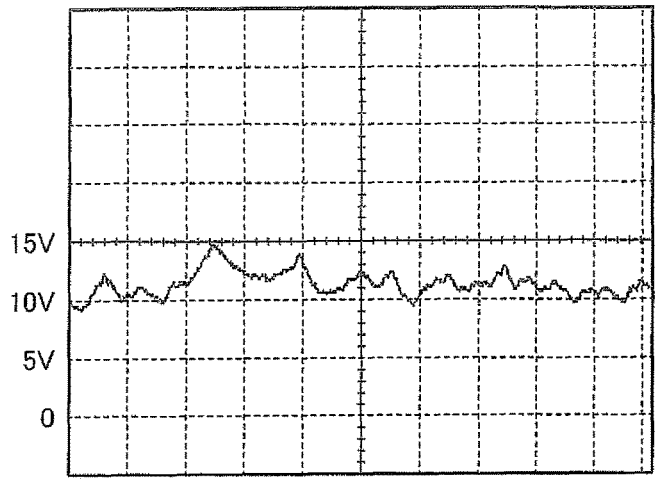
FIG. 5 is a diagram showing variations in the pressure of a conventional combustion control device.

FIG. 4 shows a second embodiment of the present invention.

In the second embodiment, parts having the same functions as in the first embodiment described above are identified with the same symbols, and a description will be given of them.

The second embodiment is characterized in that a pressure propagation delay means 21 provided partway along the pressure passage 11 is formed with a pressure adjustment valve that can adjust the speed at which the pressure is propagated.

Specifically, the pressure propagation delay means 21 formed with the pressure adjustment valve includes: a main body portion 21-1 that is arranged partway along the pressure passage 11 and that is cylindrical; an inner space 21-2 that is formed within the main body portion 21-1; a valve member 21-3 that is arranged within the inner space 21-2 and that is spherical; first and second elastic springs 21-4 and 21-5 that hold the valve member 21-3 from both sides.

Here, as shown in FIG. 4, in the main body portion 21-1, the diameter of the inner space 21-2 is gradually decreased as the inner space 21-2 extends from the center part to both ends.

At both ends of the main body portion 21-1, first and second opening portions 21-6 and 21-7 that communicate with the pressure passage 11 are provided.

The valve member 21-3 is retained by the first and second elastic springs 21-4 and 21-5 from both end sides such that within the inner space 21-2 of the main body portion 21-1, a normal position is produced in the approximate center part.

Hence, when the pressure within the mixer is varied, the increased pressure causes the valve member 21-3 of the pressure propagation delay means 21 to be moved against a force applied by the elastic springs.

Then, the gap between the valve member 21-3 and the main body portion 21-1, that is, the inner space 21-2 is varied, and thus the cross section of the pressure passage 11 is varied, with the result that the speed at which the pressure is propagated is adjusted.

More specifically, when the valve member 21-3 is in the normal position in the approximate center part of the main body portion 21-1, the inner space 21-2, which is the gap between the valve member 21-3 and the main body portion 21-1, is maximized.

Hence, since when the valve member 21-3 is moved by a variation in the pressure, the inner space 21-2 is moved only in a direction in which the inner space 21-2 is reduced, the pressure rapidly increased within the mixer is reduced by the pressure propagation delay means 21 and is transmitted to the pressure sensor.

Consequently, since the pressure propagation delay means 21 for reducing the transmission to the pressure sensor by the temporary pressure increase within the mixer is provided partway along the pressure passage 11, and the pressure propagation delay means 21 is formed with the pressure adjustment valve that adjusts the speed at which the pressure is propagated by varying the cross section of the pressure passage 11 according to the pressure within the mixer, even if the pressure within the mixer is rapidly increased at the time of ignition of the combustion control device, it is possible to reduce, with the pressure propagation delay means 21 formed with the pressure adjustment valve, the transmission of the temporarily increased pressure to the pressure sensor, to bring the pressure sensor into a non-operated state and to continue the combustion in the combustion control device.

The pressure propagation delay means 21 is formed with the pressure adjustment valve, and thus it is possible to reduce, with the first and second elastic springs 21-4 and 21-5, the pressure transmitted to the pressure sensor to an appropriate state, with the result that it is possible to reliably acquire a non-operated state of the pressure sensor when a temporary pressure increase is produced.

The present invention is not limited to the first and second embodiments described above, and various modifications are possible.

For example, although in the first embodiment of the present invention, as the pressure propagation delay means, the venture is used, and on the other hand, in the second embodiment, as the pressure propagation delay means, the pressure adjustment valve is used, it is possible to adopt a special configuration in which both of them are used in two stages.

LIST OF REFERENCE SYMBOLS

1 combustion control device
2 combustion chamber
3 burner
4 mixer
5 pressure sensor
6 heat dissipation disc
7 combustion room
8 nozzle
9 combustion fan
10 combustion fan motor
11 pressure passage
12 control means
13 pressure propagation delay means
13-1 main body portion
13-2 communication hole portion

The invention claimed is:

1. A combustion control device comprising:

a combustion chamber which has a heat dissipation disc on a front surface and within which a combustion room is formed;

a burner which is attached to the combustion chamber;

a mixer which mixes a gas supplied to the burner with air;

a pressure sensor which is connected to the mixer through a pressure passage, and which receives a pressure propagated from said mixer; and a pressure propagation delay means, which reduces transmission of said pressure to the pressure sensor caused by a temporary pressure increase within the mixer, being provided partway along the pressure passage, said pressure propagation delay means comprising a pressure adjustment valve which changes a cross section of the pressure passage according to the pressure within the mixer to adjust a speed at which the pressure is propagated through said pressure adjustment valve to said pressure sensor, the pressure adjustment valve including:

a main body portion that is arranged partway along the pressure passage and that is cylindrical;

an inner space that is formed within the main body portion and comprises a center part between opposite ends of said inner space, a diameter of the inner space being gradually decreased as the inner space extends from the center part to both of said opposite ends;

a valve member that is arranged within the inner space and that is spherical;

first and second elastic springs that hold the valve member from first and second sides; and first and second opening portions provided at opposite ends of the main body and that communicate with the pressure passage, wherein said first and second opening portions communicate with said opposite ends of said inner space to receive said pressure from said mixer and propagate said pressure to said pressure sensor;

said valve member of said pressure adjustment valve being movable in response to changes in the pressure to change a cross section of said inner space according to the temporary pressure increase of the pressure within the mixer to adjust a speed at which the pressure is propagated through said inner space to said pressure sensor.

2. The combustion control device of claim 1, wherein the pressure propagation delay means further comprises an orifice arranged partway along the pressure passage.

3. The combustion control device of claim 1, wherein said cross section is defined by a gap between said valve member and said main body portion within said inner space, said gap being varied by a position of said valve member relative to said center part and said opposite ends of said inner space.

4. The combustion control device of claim 3, wherein said gap is maximized when said valve member is positioned in a normal position within said center part of said inner space.

5. The combustion control device of claim 1, which further includes a control unit connected to said pressure sensor and said mixer to control a combustion state of said burner.

6. The combustion control device of claim 1, wherein said temporary pressure increase can be generated by a blockage of said burner and can also be generated by ignition of said burner, said pressure adjustment valve delaying said propagation of said temporary pressure increase to said pressure sensor to prevent shutdown of said burner due to said ignition unless said blockage is present.

7. A combustion control device comprising:

a combustion chamber which has a heat dissipation disc on a front surface and within which a combustion room is formed;

a burner which is attached to the combustion chamber;

a mixer which mixes a gas supplied to the burner with air;

a pressure sensor which is connected to the mixer through a pressure passage and which receives a pressure from said mixer which is propagated from said mixer to said pressure sensor through said pressure passage; and a pressure propagation delay means being provided partway along the pressure passage, wherein said pressure propagation delay means reduces transmission of said pressure propagated to the pressure sensor caused by a temporary pressure increase within the mixer, said pressure propagation delay means comprising a pressure adjustment valve which changes a cross section of the pressure passage within said pressure adjustment valve according to the pressure within the mixer to adjust a speed at which the pressure is propagated from said mixer through said pressure adjustment valve to said pressure sensor, the pressure adjustment valve comprising:

a main body portion that is arranged partway along the pressure passage and that is cylindrical;

an inner space that is formed within the main body portion and comprises a center part disposed between opposite ends of said inner space, a diameter of the inner space being gradually decreased as the inner space extends from said center part toward said opposite ends;

a valve member that is movably arranged within the inner space so as to be movable toward and away from said opposite ends;

elastic springs that apply a force to said valve member to bias said valve member toward said center part to define a cross section of said pressure passage which is open while permitting movement of said valve member toward said opposite ends to change said cross section in response to any said temporary pressure increase propagated from said mixer; and first and second opening portions that are provided at opposite ends of the main body and that communicate with said pressure passage, wherein said first and second opening portions communicate with said opposite ends of said inner space to receive said pressure from said mixer through said first opening portion and propagate said pressure through said inner space to said second opening portion and to said pressure sensor;

said valve member being movable in response to changes in the pressure to change said cross section according to the temporary pressure increase of the pressure within the mixer to adjust the speed at which the pressure is propagated to said pressure sensor.

8. The combustion control device of claim 7, which further includes a control unit connected to said pressure sensor and said mixer to control a combustion state of said burner.

9. The combustion control device of claim 7, wherein said temporary pressure increase can be generated by a blockage of said burner and can also be generated by ignition of said burner, said pressure adjustment valve delaying said propagation of said temporary pressure increase to said pressure sensor to prevent shutdown of said burner due to said ignition unless said blockage is present.

* * * * *